US009824832B2

(12) United States Patent
Larsson

(10) Patent No.: US 9,824,832 B2
(45) Date of Patent: Nov. 21, 2017

(54) CONTACT UNIT FOR A TAP CHANGER AND A TAP SELECTOR COMPRISING THE CONTACT UNIT

(71) Applicant: ABB Schweiz AG, Baden (CH)

(72) Inventor: Tommy Larsson, Ludvika (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/166,215

(22) Filed: May 26, 2016

(65) Prior Publication Data

US 2016/0351353 A1 Dec. 1, 2016

(30) Foreign Application Priority Data

May 27, 2015 (EP) ..... 15169323.1

(51) Int. Cl.
*H01H 19/00* (2006.01)
*H01H 21/00* (2006.01)
(Continued)

(52) U.S. Cl.
CPC ..... *H01H 9/0016* (2013.01); *H01H 1/365* (2013.01); *H01H 1/42* (2013.01)

(58) Field of Classification Search
CPC ..... H01H 9/0016; H01H 1/365; H01H 1/42; H01H 9/00; H01H 3/44; H01H 1/00; H01H 1/12; H01H 1/14; H01H 1/20; H01H 1/2025; H01H 1/22; H01H 1/32; H01H 1/36; H01H 1/38; H01H 1/06; H01H 3/00;
(Continued)

(56) References Cited

U.S. PATENT DOCUMENTS 2,717,296 A 9/1955 Foley et al.
4,207,445 A * 6/1980 Hammar ..... H01H 9/0005 200/11 TC
(Continued)

FOREIGN PATENT DOCUMENTS

CN 201170278 Y 12/2008
DE 2945724 A1 5/1980
(Continued)

OTHER PUBLICATIONS

European Search Report Application No. 15169323.1 Completed: Nov. 18, 2015; dated Dec. 4, 2015 8 pages.

*Primary Examiner* — Anthony R. Jimenez
(74) *Attorney, Agent, or Firm* — Whitmyer IP Group LLC

(57) ABSTRACT

Contact unit for a tap changer including a contact ring having a central axis, a plurality of fixed contacts arranged at a distance from the contact ring in different radial directions, and a moving contact arranged rotatable about the central axis of the contact ring and adapted to electrically connect the fixed contacts one at a time with the contact ring. The moving contact includes two elongated contact elements. Each of the contact elements includes a first contact area for providing electrical contact with the fixed contacts and a second contact area for providing electrical contact with the contact ring. The moving contact is designed so an electric path is formed between the first and second contact area. The first and second contact areas are positioned on opposite sides of a plane orthogonal to a longitudinal axis of the moving contact and including the central axis of the contact ring.

20 Claims, 2 Drawing Sheets

(51) Int. Cl.
*H01H 9/00* (2006.01)
*H01H 1/36* (2006.01)
*H01H 1/42* (2006.01)

(58) Field of Classification Search
CPC .. H01H 3/02; H01H 3/12; H01H 3/22; H01H 3/30; H01H 3/32; H01H 3/54; H01H 19/00; H01H 19/20; H01H 19/28; H01F 29/02; H01F 29/04
USPC ..... 200/11 J, 11 TC, 11 R, 6 R, 19.18, 200/19.19–19.22, 564, 568, 410, 200/431–435, 445, 458–462
See application file for complete search history.

(56) References Cited

U.S. PATENT DOCUMENTS 4,296,394 A * 10/1981 Ragheb ..... H01H 5/02 200/404
4,931,599 A 6/1990 Bleibtreu

FOREIGN PATENT DOCUMENTS

| | | | |
|---|---|---|---|
| GB | 1263640 | A | 2/1972 |
| JP | S5469370 | U | 5/1979 |
| WO | 9401878 | A1 | 1/1994 |
| WO | 2014124771 | A1 | 8/2014 |

* cited by examiner

CONTACT UNIT FOR A TAP CHANGER AND A TAP SELECTOR COMPRISING THE CONTACT UNIT

TECHNICAL FIELD

The present invention relates to a contact unit for a tap changer comprising a contact ring having a central axis, a plurality of fixed contacts arranged at a distance from the contact ring in different radial directions, and a moving contact arranged rotatable about the central axis of the contact ring and adapted to electrically connect the fixed contacts one at a time with the contact ring. The contact unit can be a moving contact in a tap selector or a moving contact in a diverter switch of the tap changer.

BACKGROUND

Tap changers are used for controlling the output voltage of a transformer by providing the possibility of switching in or switching out additional turns in a transformer winding. In a diverter-type tap changer, the electrical connection between fixed contact and external contact is typically formed by a diverter switch together with a tap selector.

WO2014/124771 shows examples of diverter switches for an on-load tap changer. The diverter switch comprises a main branch and a transition branch arranged alternating between first and second connection points, and an external connection point. The main branch comprises a moving contact adapted to be moved between being connected to the first connection point and connected to the second connection point. The transition branch comprises a moving contact adapted to be switched between being connected to the first connection point and to the second connection point. A control unit is configured to move, upon receipt of a signal indicative of a desire to perform a tap changing, the main branch from the first connection point to the second connection point by performing a switching sequence.

WO94/01878 discloses a tap selector for an on-load tap changer. The tap selector comprises a current connector including two tap selector shafts, a plurality of contact rings electrically connected to the current connector, a plurality of moving contact slidably connected to one of the contact rings. The tap selector further comprises a circular hollow cylinder with a closed circumference surrounding the current connector and the moving contacts, and a plurality of fixed contacts. The contacts being fixed to a wall of cylinder. Each moving contact is adapted to connect one at a time with the fixed contacts, which are placed in the same circular orbit as the contact ring. The moving contacts comprises at least two elongated contact elements in the form of contact fingers extending between the fixed contact and the contact ring and arranged in parallel. The moving contact is slidably connected to the contact ring and is rotatable about a rotational axis coinciding with a central axis of the contact ring. The contact fingers of the moving contact has a first portion adapted to electrically connect to the fixed contacts and a second portion connected to the contact ring. The contact finger has at least one contact area in the first portion for providing electrical contact with the fixed contacts and at least one contact area in the second portion for providing electrical contact with the contact ring. The contact area of the second portion is located where the contact ring is closest to the fixed contact. i.e, where the distance between the contact ring and the fixed contact is shortest.

The currents through the parallel contact fingers of the moving contact causes attraction forces between the contact fingers. Further, opposing currents in the contact areas generate separating forces. In the state of the art moving contacts, the attraction forces and separating forces are in balance. However, for some applications there is a desire to have more compact moving contacts to reduce the size of the tap changer and more particular to reduce the size of the tap selector. To achieve a more compact moving contact, the distance between the fixed contacts and the contact ring has to be reduced. Accordingly, the length of the contact fingers has to be reduced. When the length of the contact fingers is reduced, the attraction force between the contact fingers is reduced and by that the balance between the attraction forces and the separating forces is destroyed. Another problem with reducing the length of the contact fingers is that the cooling area of the moving contact becomes too small to handle high currents. One solution to this problem is to increase the number of parallel contact fingers. However, this is costly and increases the space demand rather than lower it.

SUMMARY

It is an object of the present invention to at least partly overcome the above problems, and to achieve a more compact tap selector or diverter switch, and accordingly a more compact tap changer, without increasing the number of contact elements.

This object is achieved with a contact unit as defined in the claims.

The contact unit comprises a contact ring having a central axis, a plurality of fixed contacts arranged at a distance from the contact ring in different radial directions, and a moving contact arranged rotatable about the central axis of the contact ring and adapted to electrically connect the fixed contacts one at a time with the contact ring, and the moving contact comprises two elongated contact elements. Each of the contact elements comprises a first contact area for providing electrical contact with the fixed contacts and a second contact area for providing electrical contact with the contact ring, and the moving contact is designed so that an electric path is formed between the first and second contact areas. According to the invention, the first contact area and the second contact area are positioned on opposite sides of a plane orthogonal to a longitudinal axis of the moving contact and including the central axis of the contact ring.

According to the invention, the position of the second contact area, i.e. the contact area between the contact element and the contact ring, is moved from the position where the contact ring is closest to the fixed contact, to a position on the opposite side of the contact ring where the distance between the contact ring and the fixed contact is longer. Thus, the length of the current path between the fixed contact and the contact ring can be maintained or extended, even though the distance between the fixed contact and the contact ring is reduced. By that a small and compact contact unit can be achieved, while maintaining the balance between the attraction forces and the separating forces and keeping the cooling area of the moving contact to allow handling of high currents. The attracting forces between the contact elements enable good contact forces even during short circuit.

With a contact area of an element is meant an area adapted to make electrical contact with another object, for example a fixed contact or a contact ring, so that a current can flow between the element and the object.

The moving contact is designed so that an electric path is formed between the first and second contact area. This means that there is no contact area between the contact element and the contact ring positioned on the same side of the plane as the first contact area. If there is a contact area between the contact element and the contact ring positioned on the same side of the plane as the first contact area, the current path will be formed between the first contact area and the contact area positioned on the same side of the plane as the first contact area, due to the fact that the current chooses the path with lowest impedance.

According to an embodiment of the invention, each of the contact elements has a distribution area that is the larger than a distribution area of the contact ring, and the upper and lower contact elements are arranged with their periphery outside the periphery of the contact ring so that the contact elements cover the contact ring. With the distribution area of an object is meant the area defined by the periphery of the object. Thus, the contact elements functions as a shield for the contact ring. Thus, the contact ring can be made thinner, and consequently, the distance between the contact elements can be reduced, and by that the attracting forces between the elements are increased. This embodiment further increases the contact forces between the contact elements.

According to an embodiment of the invention, each of the contact elements comprises a third contact area for providing electrical contact with the contact ring, and the second contact area and the third contact area are arranged in different radial directions of the contact ring, and on the same side of the plane orthogonal to the longitudinal axis of the moving contact and including the central axis of the contact ring. By providing two contact areas in the second portion in two different radial directions two current paths are formed between the first contact area and the contact ring. Having two contact areas on the opposite side of the plane improves the mechanical balance of the contact unit. Further, the contact force on each of the contact areas sliding on the contact ring is reduced.

According to an embodiment of the invention, the second and third contact areas are arranged on opposite sides of a second plane parallel to the longitudinal axis of the moving contact and including the central axis of the contact ring. This embodiment further improves the mechanical balance of the contact unit.

According to an embodiment of the invention, edges on the periphery of the contact parts at least partly are rounded. Preferably, all of the edges on the periphery of the contact parts are rounded. This embodiment achieves a dielectrically advantageous shape.

According to an embodiment of the invention, the contact unit comprises a current connector electrically connected to the contact ring, and each of the second portions of the contact elements is provided with a through hole for receiving the current connector. Suitably, the diameter of the through hole is larger than the diameter of the current connector and smaller than the outer diameter of the contact ring. Preferably, the through hole is aligned with the contact ring. More preferably, the through hole is arranged concentrically with the contact ring. This will provide for an optimal location of the through hole. Suitably, the diameter of the through hole is equal or larger than the distance between the first and second contact area.

The through hole is positioned so that a first current path is formed between the first contact area and the second contact area, and a second current path is formed between the first contact area and the third contact area, and the first and second current paths are formed on opposite sides of the through hole. A consequence of the through hole is that it forces the current paths to be formed on opposite sides of the hole and by that slightly increasing the distance between the current paths and thus to prolong the current paths. By that the attracting forces between the elements are further increased.

According to an embodiment of the invention, the contact unit comprises an elongated support member for supporting the moving contact, and the through hole is designed for receiving the support member. The though hole is preferably aligned with the central axis of the contact ring. Suitably, the through hole corresponds to the circular opening of the contact ring, and is arranged concentrically with the contact ring. By this embodiment, the contact elements do no longer need to be mechanically connected to the contact ring by clamping the periphery of the contact ring, as in the prior art. Instead, the support elements can be mechanically connected to the support member. This means that the contact ring no longer need to carry the weight of the moving contact. For example, the support member is a current connector electrically connected to the contact ring.

According to an embodiment of the invention, at least the second contact area is protruding from a surface of the contact element. If there are two or more contact areas, each of the contact areas are protruding from the surface of the contact element. By that a defined contact area is achieved.

According to an embodiment of the invention, each of the contact elements extends from the fixed contacts to the contact ring, and further past and beyond the contact ring. This embodiment makes it possible to provide a hole through the contact element to receive a support member or a current connector.

According to an embodiment of the invention, the two elongated contact elements comprises an upper contact element and a lower contact element extending on opposite sides of the contact ring, and the contact ring is arranged between the upper and lower contact elements. Preferably, the upper and lower contact elements are arranged with their longitudinal axis in parallel.

According to an embodiment of the invention, a portion of the contact elements has a width larger than an outer diameter of the contact ring and the contact element is tapering from the portion towards the first contact area.

According to an embodiment of the invention, the contact unit comprises a current connector electrically connected to the contact ring, and the current connector is tubular and arranged concentrically with the contact ring. Suitably, the current connector is arranged with its central axis in parallel with the central axis of the contact ring.

According to an embodiment of the invention, the current connector is designed as an elongated support member for supporting the moving contact, and the through hole is designed for receiving current connector. Thus, the current connector also functions as a support member for supporting the moving contact. By that, the support shafts in the prior art tap selector can be omitted and the number of parts in the tap selector can be reduced.

According to an embodiment of the invention, the moving contact is slidably connected to the contact ring. In this embodiment, the contact ring is fixed and the moving contact is arranged rotatable about the central axis of the contact ring. However, in another embodiment it is also possible that the moving contact is fixedly connected to the contact ring, and the contact ring is arranged rotatable about its central axis.

The invention further relates to a tap selector for a tap changer, wherein the tap selector comprises a contact unit according to the invention. The tap selector includes the fixed contacts, the contact ring and the moving contact. In this embodiment the moving contact is arranged in a tap selector. Thus, a compact tap selector is achieved and by that the size of the tap changer is reduced.

The invention further relates to a diverter switch for a tap changer, and the diverter switch comprises at least one contact unit according to the invention. In this embodiment the contact unit is arranged in a diverter switch for a tap changer. Thus, a compact diverter switch is achieved, and by that the size of the tap changer is also reduced.

BRIEF DESCRIPTION OF THE DRAWINGS

The invention will now be explained more closely by the description of different embodiments of the invention and with reference to the appended figures.

DETAILED DESCRIPTION

Tap changers are used for controlling the output voltage of a transformer by providing the possibility of switching in or switching out additional turns in a transformer winding. A tap changer comprises a set of fixed contacts which are connectable to a number of taps of a regulating winding of a transformer, where the taps are located at different positions in the regulating winding. A tap changer further comprises at least one moveable contact which is connected to a current connector at one end, and connectable to one of the fixed contacts at the other end. By switching in or out the different taps, the effective number of turns of the transformer can be increased or decreased, thus regulating the output voltage of the transformer. In a diverter-type tap changer, the electrical connection between the fixed contacts and an external contact is typically formed by a diverter switch together with a tap selector.

Figure 1:
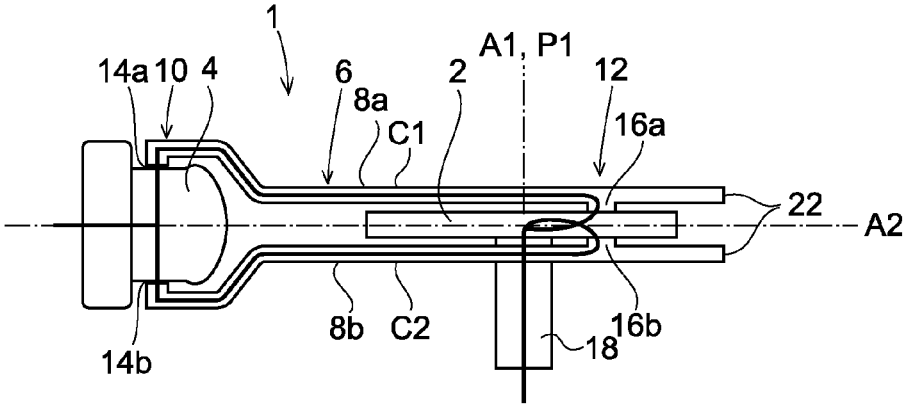
FIG. 1 shows a side view of a contact unit according to an embodiment of the invention.
Figure 2:
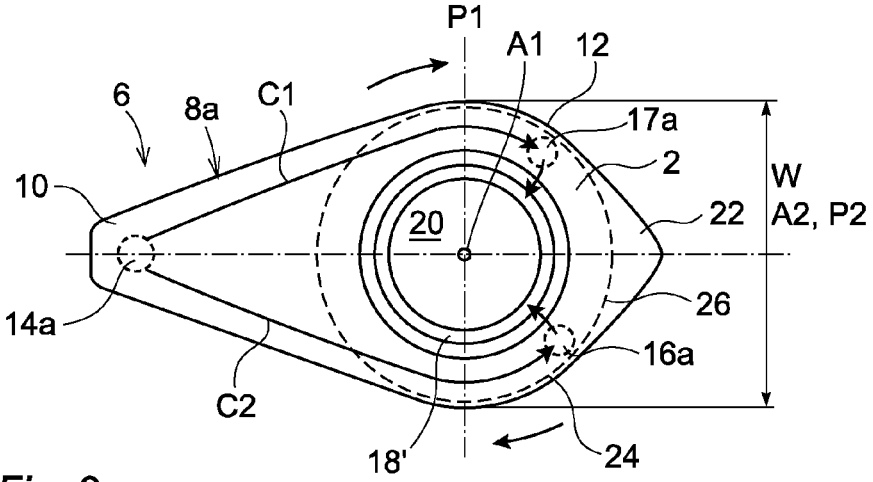
FIG. 2 is shows a top view of the contact unit.

FIG. 1 shows a side view of a contact unit 1 for a tap changer according to a first embodiment of the invention. FIG. 2 shows a top view of the contact unit 1 shown in FIG. 1 The contact unit 1 comprises a contact ring 2 having a central axis A1, a plurality of fixed contacts 4 (only one contact shown in the figures) arranged at a distance from the contact ring in different radial directions, and a moving contact 6 arranged rotatable about the central axis Al of the contact ring 2 and adapted to electrically connect the fixed contacts 4 one at a time with the contact ring 2. The contact ring can be ring shaped with an opening, or disc shaped. The opening of the contact ring can be symmetric or asymmetric. The moving contact can be slidably connected to the contact ring, or fixedly connected to the contact ring.

In the FIGS. 1 and 2, only one fixed contact 4 is shown. The moving contact 6 comprises two elongated contact elements 8*a-b* and has a longitudinal axis A2. The contact elements and the contact ring is made of an electrically conducting material, for example of metal. Each of the elongated contact elements 8*a-b* has a first portion 10 adapted to electrically connect to the fixed contacts 4 and a second portion 12 electrically connected to the contact ring 2. The first and second portions 10, 12 are positioned on opposite sides of a plane P1 orthogonal to the longitudinal axis A2 of the moving contact and including the central axis A1 of the contact ring.

Each of the contact elements 8*a-b* has at least one contact area 14*a-b* in the first portion 10 for providing electrical contact with the fixed contacts 4, and at least one contact area 16*a-b* in the second portion 12 for providing electrical contact with the contact ring 2. The contact area 14*a-b* in the first portion 10 is in the following denoted the first contact area. The contact area 16*a-b* in the second portion 12 is in the following denoted the second contact area. The first contact area 14*a-b* and second contact area 16*a-b* are positioned on opposite sides of the plane P1.

In the embodiment shown in FIGS. 1 and 2, each of the contact elements 8*a-b* comprises two contact areas 16*a-b* and 17*a* in the second portion 12 for providing electrical contact with the contact ring 2. The contact area 17*a* in the second portion 12 is in the following denoted the third contact area. However, in another embodiment of the invention, it is also possible to have only one contact area in the second portion. In such embodiment, the second contact area is suitably positions at or close to the longitudinal axis A2 of the contact element.

As seen from FIG. 1, each of the first portions 10 of the contact elements comprises a protruding part protruding from the surface of the first portions 10 facing the fixed contact, and the first contact areas 14*a-b* are formed between the protruding part and the fixed contact. Each of the second portions 12 of the contact elements comprise protruding parts protruding from the surface of the second portion facing the contact ring, and the second and third contact areas 16*a-b*, 17*a* are formed between the protruding parts and the contact ring 2. Thus, the second and third contact areas 16*a-b*, 17*a* are protruding from a surface of the second portion, and the contact areas 14*a-b* in the first portion 10 are protruding from a surface of the first portion.

The second and third contact areas 16*a*, 17*a* are arranged in different radial directions of the contact ring and on the same side of the plane P1. Preferably, the second and third contact areas 16*a*, 17*a* are arranged on opposite sides of a second plane P2 parallel to the longitudinal axis of the moving contact and including the central axis A1 of the contact ring, in order to provide a mechanically more stable contact. The second and third contact areas 16*a*, 17*a* are arranged at a distance from each other. The contact unit further comprises a current connector 18 electrically connected to the contact ring 2.

As seen from FIGS. 1 and 2, a first current path C1 is formed between the contact area 14*a* in the first portion 10 and the contact area 16*a* in the second portion 12, and a second current path C2 is formed between the contact area 14*a* in the first portion and the contact area 17*a* in the second portion. The current paths C1, C2 are further formed between the second and third contact areas 16*a*, 17*a* and the current connector 18, via the contact ring 2, as shown in FIG. 1.

Each of the contact elements 8*a-b* is provided with a through hole 20 aligned with the central axis A1 of the contact ring 2, and accordingly aligned with the rotational axis of the moving contact. The through hole is circular, and is arranged concentrically with the central axis A1 of the contact ring. The diameter of the through hole 20 can be larger than the diameter of the current connector 18, and smaller than the outer diameter of the contact ring. The through hole 20 is designed for receiving the current connector 18. As seen from FIG. 2, the through hole 20 is positioned so that and the first and second current paths C1, C2 are formed on opposite sides of the through hole 20.

The contact elements 8*a-b* extend from the fixed contact 4 to the contact ring 2, and further past and beyond the contact ring. A seen from FIGS. 1 and 2, an outer part 22 of the contact elements extends outside the contact ring 2 on opposite sides of the contact ring compared to the fixed contact 4. The contact element 8*a* is an upper contact element and the contact element 8*b* is a lower contact element, arranged below the upper contact element. The contact elements 8*a-b* extends on opposite sides of the contact ring. The contact ring 2 is arranged between the contact elements 8*a-b*.

As seen from FIG. 2, each of the contact elements 8*a-b* has a distribution area that is the larger than a distribution area of the contact ring, and the contact elements 8*a-b* are arranged with their periphery 24 outside the periphery 26 of the contact ring 2 so that the contact elements cover the contact ring. The distribution area of the contact element is the area defined by the periphery of the contact element, and the distribution area of the contact ring is the area defined by the periphery of the contact ring. The second portion 12 of the contact elements has a width w that is larger than an outer diameter of the contact ring and the contact elements are tapering towards the first portion 10. The width w of the second portion is for example about 75 mm. The diameter of the through hole is for example about 50 mm.

Figure 3:
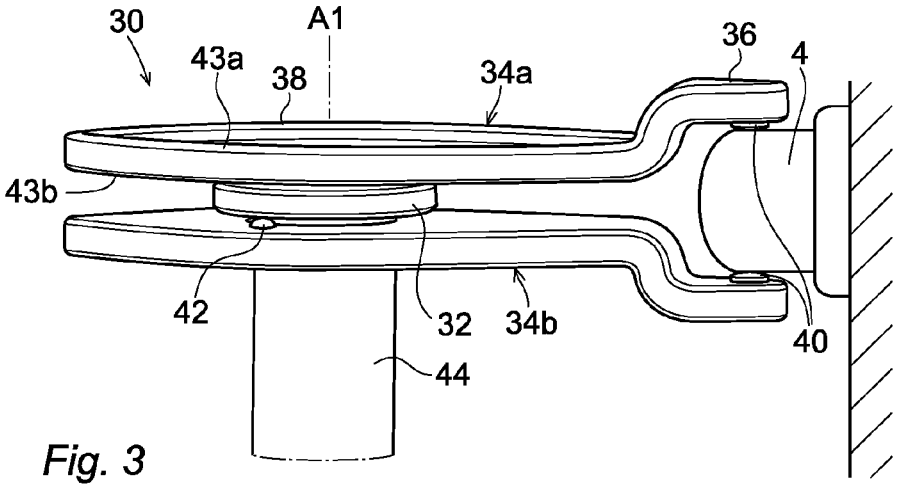
FIG. 3 shows a perspective view of another example of a contact unit according to the invention.

FIG. 3 shows a perspective view of another example of a contact unit 30 for a tap changer according to the invention. The contact unit 30 comprises a contact ring 32, a plurality of fixed contacts 4 arranged at a distance from the contact ring, and a moving contact arranged rotatable about a central axis of the contact ring and the moving contact comprises two elongated contact elements 34*a-b* having a first portion 36 adapted to electrically connect to the fixed contacts and a second portion 38 electrically connected to the contact ring. Each of the contact elements 34*a-b* comprises a contact area 40 in the first portion 36 for providing electrical contact with the fixed contact 6 and two contact areas 42 (only one contact area is shown in the figure) in the second portion 38 for providing electrical contact with the contact ring 32. The contact area 40 in the first portion and the contact areas 42 in the second portion are positioned on opposite sides of a plane orthogonal to a longitudinal axis of the moving contact and including the central axis A1 of the contact ring. An upper edge 43*a* and a lower edge 43*b* on the periphery of the contact parts is rounded in order to achieve a dielectrically advantageous shape, as seen from the FIG. 3.

The contact unit 30 comprises a current connector 44 electrically connected to the contact ring 32. In this embodiment, the current connector 44 is tubular and arranged concentrically with the contact ring 32. The current connector is attached to the contact ring. In this embodiment, the contact ring is ring shaped with a central opening. The diameter of the central opening of the contact ring may be slightly larger than the diameter of the current connector to allow the current connector to pass through the opening of the contact ring. The current connector also functions as a member for supporting the moving contact.

Figure 4:
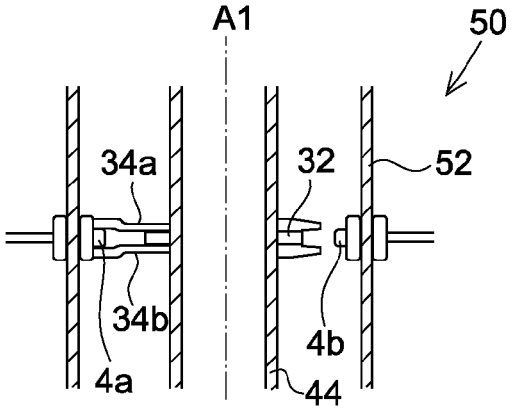
FIG. 4 shows an example of a tap selector including a contact unit according to one embodiment of the invention.

FIG. 4 shows an example of a tap selector 50 including a contact unit 30 according to the second example of the invention. The tap selector is intended to cooperate with a diverter switch (not shown) for switching during operation between different taps on a transformer winding. The contact unit 30 comprises a moving contact including two elongated contact elements 34*a-b* and arranged rotatable about a rotational axis A1. The tap selector comprises an insulating hollow cylinder 52 supporting a plurality of fixed contacts 4*a-b* located on a circular orbit which is concentric with the axis of rotation A1. The fixed contacts 4*a-b* are intended to be connected to different taps of the regulating winging of a transformer. The moving contact is arranged on the same vertical level as the fixed contacts and is adapted to cooperate with the fixed contacts.

The tap selector further comprises a current connector 44 and a contact ring 32 also arranged concentric with the axis of rotation A1. The current connector 44 may support a plurality of moving contacts arranged above each other along the current connector. The contact elements 34*a-b* are provided with through holes for receiving the current connector.

Figure 5:
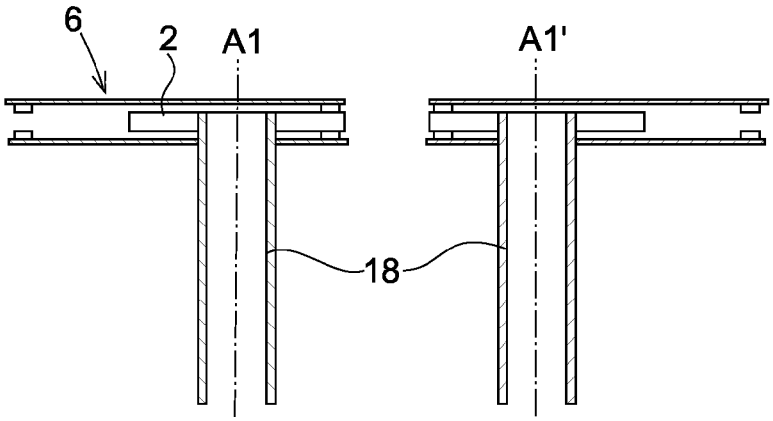
FIG. 5 shows two contact units arranged side by side in a horizontal direction with two parallel rotational axes.
Figure 6:
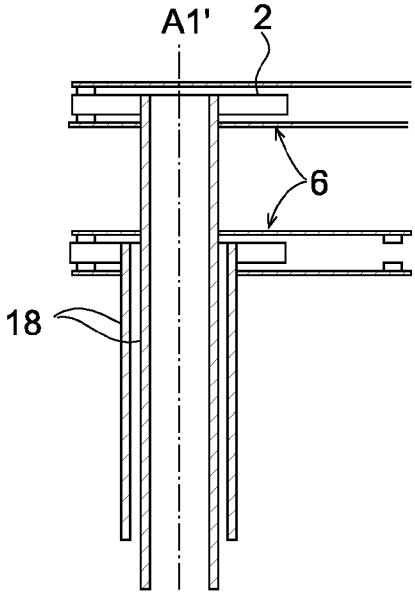
FIG. 6 shows two contact units arranged aligned in a vertical direction and with a common rotational axis.

FIGS. 5 and 6 show two different ways to arrange the contact units according to the invention in a tap selector. FIG. 5 shows two contact units arranged side by side and at a horizontal distance from each other. The two contact units has two parallel rotational axes A1 and A1', In this embodiment only the lower contact element needs to be provided with a through hole 20. FIG. 6 shows two contact units arranged aligned in a vertical direction and with a common rotational axis A1', The contact units are arranged coaxially. In this embodiment, the upper and lower contact elements are provided with a through hole to allow the current connector of the above contact unit to pass through.

The present invention is not limited to the embodiments disclosed but may be varied and modified within the scope of the following claims. For example, the shape of the contact elements may vary. The number of contact areas in the second portion may vary, for example between one and four. In another embodiments of the invention, the through hole 20 can be omitted.

What is claimed is:

1. A contact unit for a tap changer comprising:

a contact ring having a central axis, a plurality of fixed contacts arranged at a distance from the contact ring in different radial directions, and a moving contact being rotatable about the central axis of the contact ring and configured to electrically connect the fixed contacts one at a time with the contact ring, the moving contact having an upper contact element and a lower contact element which extend on opposing sides of the contact ring such that the contact ring is disposed between the upper contact element and the lower contact element, each of the contact elements comprises a first contact area for providing electrical contact with the fixed contacts and a second contact area for providing electrical contact with the contact ring, and the moving contact provides an electric path between the first and second contact areas, wherein the first contact area and the second contact area of each of the contact elements are positioned on opposite sides of a plane orthogonal to a longitudinal axis of the moving contact and including the central axis of the contact ring.

2. The contact unit according to claim 1, wherein each of the contact elements has a distribution area that is the larger than a distribution area of the contact ring, and the contact elements are arranged with their periphery outside the periphery of the contact ring so that the contact elements cover the contact ring.

3. The contact unit according to claim 1, wherein each of the contact elements comprises a third contact area for providing electrical contact with the contact ring, and the second contact area and the third contact area are arranged in different radial directions of the contact ring, and on the same side of said plane.

4. The contact unit according to claim 1, wherein edges on the periphery of the contact parts at least partly are rounded.

5. The contact unit according to claim 1, wherein each of the contact elements extends from the first contact area to the contact ring, and further past and beyond the contact ring.

6. The contact unit according to claim 1, wherein the contact unit comprises a current connector electrically connected to the contact ring, and the current connector is tubular and arranged concentrically with the contact ring.

7. The contact unit according to claim 1, wherein the moving contact is slidably connected to the contact ring.

8. The contact unit according to claim 1, wherein the upper and lower contact elements extend outwardly in a radial direction from the contact ring such that when the moving contact is aligned with one of the fixed contacts, the upper contact element and the lower contact element are disposed on opposing sides of said one of the fixed contacts.

9. The contact unit according to claim 1, wherein the contact ring is ring-shaped or disc-shaped.

10. The contact unit according to claim 1, wherein the moving contact is elongated and the longitudinal axis of the moving contact is orthogonal to the central axis of the contact ring.

11. The contact unit according to claim 1, wherein each of the contact elements provides an electric path between the first contact area and the second contact area of the respective contact element.

12. The contact unit according to claim 1, wherein for each of the contact elements, a portion of the contact element has a width larger than an outer diameter of the contact ring and the contact ring tapers from said portion towards the first contact area.

13. The contact unit according to claim 1, wherein the first contact area of each of the contact elements protrudes from a surface of the contact element in a direction non-parallel to the longitudinal axis of the moving contact.

14. The contact unit according to claim 1, wherein, for each contact element, the second contact area protrudes from a surface of the contact element.

15. The contact unit according to claim 14, wherein the second contact area protrudes from the surface of the contact element in a direction non-parallel to the longitudinal axis of the moving contact.

16. A contact unit for a tap changer comprising:

a contact ring having a central axis, a plurality of fixed contacts arranged at a distance from the contact ring in different radial directions, and a moving contact being rotatable about the central axis of the contact ring and configured to electrically connect the fixed contacts one at a time with the contact ring, the moving contact having two contact elements, each of the contact elements comprises a first contact area for providing electrical contact with the fixed contacts and a second contact area for providing electrical contact with the contact ring, and the moving contact providing an electric path between the first and second contact areas, wherein the first contact area and the second contact area of each of the contact elements are positioned on opposite sides of a plane orthogonal to a longitudinal axis of the moving contact and including the central axis of the contact ring, wherein each of the contact elements comprises a third contact area for providing electrical contact with the contact ring, the second contact area and the third contact area being arranged in different radial directions of the contact ring and on the same side of said plane, and wherein said second and third contact areas are arranged on opposite sides of a second plane parallel to the longitudinal axis of the moving contact and including the central axis of the contact ring.

17. A contact unit for a tap changer comprising:

a contact ring having a central axis, a plurality of fixed contacts arranged at a distance from the contact ring in different radial directions, and a moving contact being rotatable about the central axis of the contact ring and configured to electrically connect the fixed contacts one at a time with the contact ring, the moving contact having two contact elements, each of the contact elements comprises a first contact area for providing electrical contact with the fixed contacts and a second contact area for providing electrical contact with the contact ring, and the moving contact providing an electric path between the first and second contact areas, wherein the first contact area and the second contact area of each of the contact elements are positioned on opposite sides of a plane orthogonal to a longitudinal axis of the moving contact and including the central axis of the contact ring, wherein the contact unit comprises a current connector electrically connected to the contact ring, and at least one of the contact elements is provided with a through hole for receiving the current connector.

18. The contact unit according to claim 17, wherein said through hole is arranged concentrically with the contact ring.

19. The contact unit according to claim 17, wherein said through hole is arranged concentrically with the current connector.

20. A tap selector for a tap changer, wherein the tap selector comprises a contact unit including:

a contact ring having a central axis, a plurality of fixed contacts arranged at a distance from the contact ring in different radial directions, and a moving contact being rotatable about the central axis of the contact ring and configured to electrically connect the fixed contacts one at a time with the contact ring, the moving contact having an upper contact element and a lower contact element which extend on opposing sides of the contact ring such that the contact ring is disposed between the upper contact element and the lower contact element, each of the contact elements comprises a first contact area for providing electrical contact with the fixed contacts and a second contact area for providing electrical contact with the contact ring, and the moving contact provides an electric path between the first and second contact areas, wherein the first contact area and the second contact area of each of the contact elements are positioned on opposite sides of a plane orthogonal to a longitudinal axis of the moving contact and including the central axis of the contact ring.

* * * * *